US005155925A

United States Patent [19]

Choi

[11] Patent Number: 5,155,925

[45] Date of Patent: Oct. 20, 1992

[54] PORTABLE LPG-POWERED HAIR DRYER

[76] Inventor: Wonchoel Choi, Baekjoe Apt. A-206, 34/5, 501-1, Hadan-Dong, Shah-Ku, Pusan, Rep. of Korea

[21] Appl. No.: 810,673

[22] Filed: Dec. 19, 1991

[30] Foreign Application Priority Data

Nov. 21, 1991 [KR] Rep. of Korea ..... 91-20244

[51] Int. Cl.[5] ..... A45D 20/06

[52] U.S. Cl. ..... 34/97; 432/222

[58] Field of Search ..... 34/97; 432/222; 431/344; 126/401, 409, 408, 208

[56] References Cited

U.S. PATENT DOCUMENTS 4,555,232 11/1985 Raccah et al. ..... 34/97
4,635,382 1/1987 Bourdeau ..... 34/97
4,800,654 1/1989 Levin et al. ..... 34/97
4,995,171 2/1991 Yoshinaga et al. ..... 34/97

*Primary Examiner*—Henry A. Bennet
*Attorney, Agent, or Firm*—Notaro & Michalos

[57] ABSTRACT

In order to make a hair dryer available outdoors or where a general power source is not available, an LPG powered hair dryer is provided. The hair dryer comprises a main body which can receive a bottle of LPG (liquified petroleum gas), and a burner in the main body for burning the LPG. The burner flame heats a double radiant plate arrangement in front of the burner and hot air is blow from the plate arrangement by a battery powered fan motor at the rear of the housing. A gas-interrupting valve, a gas-adjusting valve, an operation switch and a thermal sensor are also provided in the housing.

9 Claims, 2 Drawing Sheets

PORTABLE LPG-POWERED HAIR DRYER

FIELD AND BACKGROUND OF THE INVENTION

The present invention relates in general to hair dryers, and in particular to a new and useful hair dryer which is entirely portable and self contained, heat for the hair dryer being generated by an LPG fired burner.

The conventional hair dryer is usable only when there is a general power source (100–220 V AC) available. Since it uses a power-consuming coil-type heat source, it is not practical to manufacture a portable hair dryer which is powered by a charger or a battery.

In the case of a woman in particular, she usually dresses her hair in her house or at a beauty parlor. When it is windy, or when she is exposed to rain or when on a trip for a long time or when her hair is disheveled, she has to visit a nearby beauty salon. When it is not easy to do so, she must remain with her hair unkempt or use a mousse or hair cream for dressing her hair. These instances are unpleasant and unnerving.

Such a problem cannot be solved by the conventional hair dryer or by using a large and heavy battery or by carrying a dryer about, for use with a power source in another house, store or location.

SUMMARY OF THE INVENTION

The present invention relates in general to a hair dryer which generates heat, not by using a general power source, but by using LPG. The invention provides a portable hair dryer which can conveniently dry hair anywhere, indoors or outdoors.

Accordingly, an object of the present invention is to provide a portable LPG fired hair dryer which includes a battery powered motor with fan for blowing air through the dryer. A burner which burns LPG, directs its flame against a pair of spaced apart plates which act as the heat source. The air passing through the blower body carries heat from the plates in the form of a stream of hot air for use in drying hair.

A further object of the present invention is to provide a completely portable yet powerful hair dryer which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
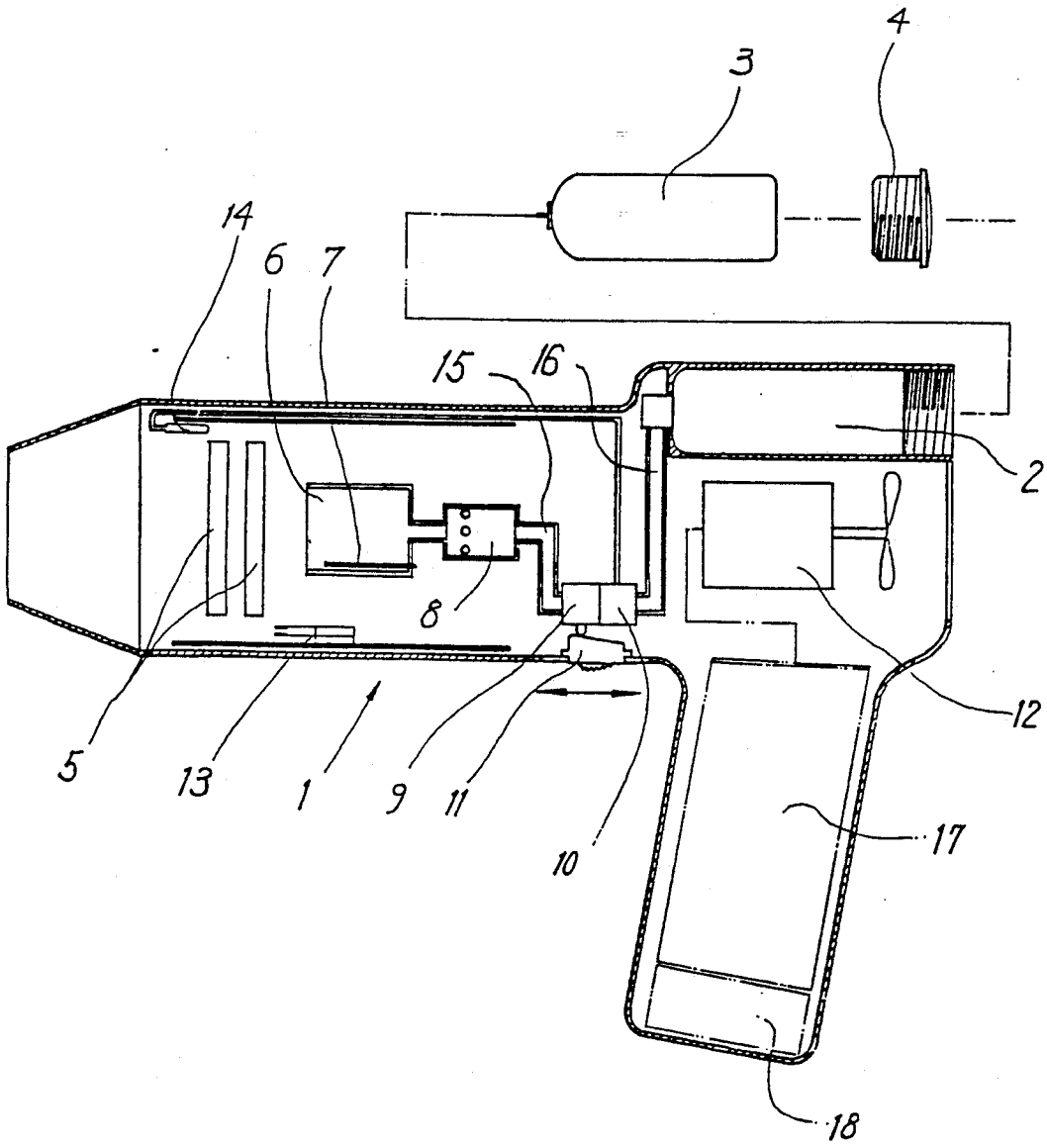
FIG. 1 is a sectional and partly exploded view showing the structure of the present invention.

Referring to FIG. 1, an LPG bottle 3 is inserted into a bottle receiving chamber 2 in the main body 1 of the inventive dryer, and a bottle fixing screw 4 is threaded into the chamber behind the bottle. A nipple or conduit

16 communicates the bottle 3 with a gas-interrupting or interrupt valve 10 and a gas-adjusting valve 9 that are connected in series with each other. An air intake 8 and a burner 6 with a built-in lighter 7 are connected by a nipple or conduit 15, to the valve 9. In front of the burner 9, a twofold or double radiant plate arrangement 5, 5 is inserted. To the lower part of gas-adjusting valve 9 a valve-operating switch 11 is attached. In the upper and lower parts of the main body 1 of the dryer, a gas-interrupting thermal sensor 14 and a bimetal switch 13 are provided. A fan motor 12 with fan is placed in the rear of the body. The handle of the body 1 is furnished with a batter 17 and a charger 18.

Fan motor 12 comprises fan means for blowing air from the open rear end of main body 1, through the body and past plate arrangement 5, 5, where the air is heated and then passes out through the front end of the main body. The plate arrangement comprises first and second plates positioned across the front of the burner 6 and spaced from each other in the direction of air flow through the main body 1.

The gas bottle 3, burner 6, lighter 7, air inlet 8, gas-adjusting valve 9, gas-interrupting valve 10, operating switch 11, fan motor 12, bi-metal switch 13, gas-interrupting sensor 14, conduits 15 and 16, battery 17, and charger 18 are all well known conventional elements which are commercially available.

The main merit of the present invention is that it can be used without any electrical wire. It can also be used as a non-portable but cordless dryer, if desired, where electrical power is available.

It is economical as it does not use an expensive power source but uses cheap LPG. Examples of LPG or liquified petroleum gas are propane and butane.

As the dryer of the invention does not require a cord, its design is refined and it accordingly rises in commercial value. The invention solves a problem caused by being limited in use to the length of a cord as in the conventional product. Being useable even when electricity is off, the invention is very convenient.

Since the fan motor 12 causes air to flow to the front of the body at all times, the bottle 3 and chamber 2 are not heated, and so the invention is not dangerous but very safe. Unlike the conventional hair dryer, it is not necessary to make frequent repairs of the dryer due to snapping of the cord and there is no danger of a melting down of the main body or burning of the hair due to an overheated electrical coil.

Figure 3:
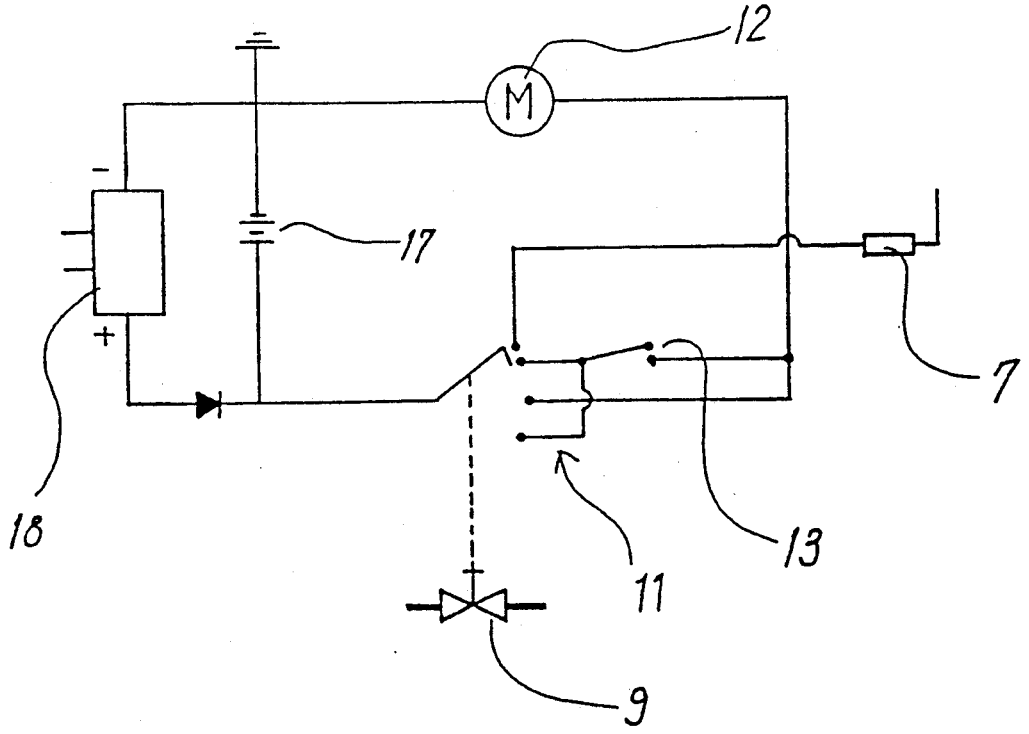
FIG. 3 is a circuit diagram of the present invention.

In operation, the switch 11 is pushed to the front, opening the gas flow to burner 6. The gas is ignited by the lighter 7 at the same time that it is discharged and the fan motor 12 turns on. See the circuit of FIG. 3. Heat generated by ignition closes the bimetal switch 13. As shown in FIG. 3, this is required to maintain power to the fan motor 12 in the end positions of switch 11.

Next, the amount of gas discharged is adjusted by adjusting the position of operation switch 11 to the front or to the rear. This motion moves a ramp on switch 11 along the plunger of valve 9 to release more or less gas from bottle 3.

When the operation switch 11 is off, gas discharge comes to a stop but, in order to cool the remaining heat, the fan motor 12 is made to stay on until the bimetal switch 13 opens as the unit cools.

The gas interrupted thermal sensor 14 interrupts the gas supply through interrupt valve 10, when the battery 17 is discharged completely and the air flow stops, or when the inside of body 1 is overheated for any other reason.

Figure 2:
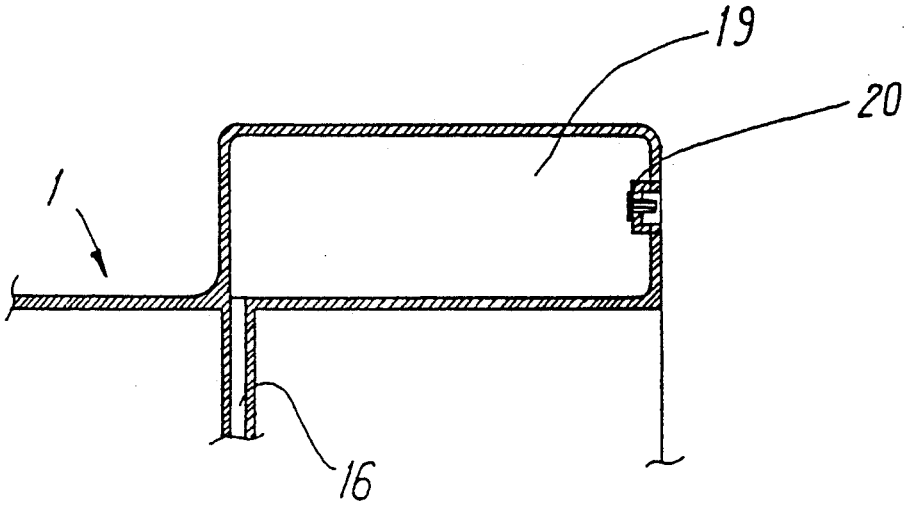
FIG. 2 is a partial sectional view showing another embodiment of the present invention.

FIG. 2 illustrates an alternate embodiment of the invention which includes means defining a gas storing chamber 19 for receiving a supply of LPG through a one-way gas injecting valve 20. One end of conduit or nipple 16 is connected to the gas chamber 19 for supplying gas to the valves and other elements of the invention which are otherwise the same as in FIG. 1. In FIG. 2, the separate gas bottle 3, bottle receiving chamber 2 and bottle fixing screw 4 are replaced by the gas chamber 19 and the injection valve 20. This forms an embodiment of the invention which can be recharged from any source of LPG and used until the gas can be replenished.

As described hereinabove, the present invention is convenient in use, excellent in performance and satisfactory in safety as a portable device.

While a specific embodiment of the invention has been shown and described in detail to illustrate the application of the principles of the invention, it will be understood that the invention may be embodied otherwise without departing from such principles.

What is claimed is:

1. A portable, gas fired hair dryer, comprising:

a main body (1);

receiving means (2) connected to said body for receiving a container of burnable gas;

container fixing means (4) engageable with said receiving means for fixing a gas container to the body;

a first conduit (16) having one end connected to said receiving means for receiving gas from a gas container received by said receiving means, said first conduit having an opposite end;

a gas interrupting valve (10) and gas-adjusting valve (9) connected in series to each other and together connected to the opposite end of said first conduit, said gas-interrupting valve functioning when open to pass gas therethrough and when closed to interrupt a flow of gas therethrough, said gas-adjusting valve having a plunger for adjusting a flow of gas through said gas adjusting valve;

a second conduit (15) having one end connected to said combined series connected gas-interrupting and gas-adjusting valves, said second conduit have an opposite end;

an air intake (8) connected to the opposite end of said second conduit for mixing air with gas supplied through said second conduit;

a burner containing a lighter for receiving and burning a gas plus air mixture from said air intake, said burner being connected to said air intake, said burner being positioned for discharging of flame in a forward direction toward a front of said main body;

double plate means (5) positioned in said main body in front of said burner for being heated by a flame from said burner; and a valve operating switch movably connected to said main body and movable against said plunger for adjusting a flow of gas through said gas-adjusting valve.

2. A hair dryer according to claim 1, wherein said receiving means comprises a container receiving chamber defined in said main body, said container fixing means comprising a fixing screw engageable to said chamber for retaining a gas container in said chamber.

3. A hair dryer according to claim 1, including fan means in said main body for passing air through said main body, past said plate means out through the front of said main body.

4. A hair dryer according to claim 3, wherein said plate means comprises a pair of spaced apart plates extending across a front of said burner.

5. A portable, gas fired hair dryer, comprising:

a main body (1);

gas receiving means for receiving a supply of burnable gas in said main body;

a first conduit (16) having one end connected to said gas receiving means for receiving gas therefrom said first conduit having an opposite end;

a gas interrupting valve (10) and gas-adjusting valve (9) connected in series to each other and together connected to the opposite end of said first conduit, said gas-interrupting valve functioning when open to pass gas therethrough and when closed to interrupt a flow of gas therethrough, said gas-adjusting valve having a plunger for adjusting a flow of gas through said gas adjusting valve;

a second conduit (15) having one end connected to said combined series connected gas-interrupting and gas-adjusting valves, said second conduit have an opposite end;

an air intake (8) connected to the opposite end of said second conduit for mixing air with gas supplied through said second conduit;

a burner containing a lighter for receiving and burning a gas plus air mixture from said air intake, said burner being connected to said air intake, said burner being positioned for discharging of flame in a forward direction toward a front of said main body;

double plate means (5) positioned in said main body in front of said burner for being heated by a flame from said burner; and a valve operating switch movably connected to said main body and movable against said plunger for adjusting a flow of gas through said gas-adjusting valve.

6. A hair dryer according to claim 5, wherein said gas receiving means comprises means in said main body for defining a gas chamber (19) said first conduit being connected to said gas chamber, and a gas injection valve (20) connected to said gas chamber for receiving a supply of burnable gas in said gas chamber.

7. A hair dryer according to claim 6, wherein said plate means comprises a pair of spaced apart plates extending across a front of said burner.

8. A hair dryer according to claim 5, including fan means in said main body for passing air through said main body, past said plate means out through the front of said main body.

9. A hair dryer according to claim 5, wherein said receiving means comprises a container receiving chamber defined in said main body, said container fixing means comprising a fixing screw engageable to said chamber for retaining a gas container in said chamber.

* * * * *